US010347177B2

(12) United States Patent
Zhang et al.

(10) Patent No.: US 10,347,177 B2
(45) Date of Patent: Jul. 9, 2019

(54) PIXEL DRIVING CIRCUIT FOR AVOIDING FLICKER OF LIGHT-EMITTING UNIT, DRIVING METHOD THEREOF, AND DISPLAY DEVICE

(71) Applicants: BOE TECHNOLOGY GROUP CO., LTD., Beijing (CN); HEFEI XINSHENG OPTOELECTRONICS TECHNOLOGY CO., LTD., Hefei, Anhui (CN)

(72) Inventors: Yuting Zhang, Beijing (CN); Feng Liao, Beijing (CN); Zhongyuan Wu, Beijing (CN); Pan Xu, Beijing (CN)

(73) Assignees: BOE TECHNOLOGY GROUP CO., LTD., Beijing (CN); HEFEI XINSHENG OPTOELECTRONICS TECHNOLOGY CO., LTD., Hefei, Anhui (CN)

( * ) Notice: Subject to any disclaimer, the term of this patent is extended or adjusted under 35 U.S.C. 154(b) by 16 days.

(21) Appl. No.: 15/168,886

(22) Filed: May 31, 2016

(65) Prior Publication Data

US 2017/0018229 A1 Jan. 19, 2017

(30) Foreign Application Priority Data

Jul. 17, 2015 (CN) ..... 2015 1 0427812

(51) Int. Cl.
*G09G 3/3258* (2016.01)
*G09G 3/3266* (2016.01)
*G09G 3/3233* (2016.01)

(52) U.S. Cl.
CPC ... *G09G 3/3233* (2013.01); *G09G 2300/0819* (2013.01); *G09G 2300/0852* (2013.01);
(Continued)

(58) Field of Classification Search
CPC ..... G09G 3/3233; G09G 2320/0247; G09G 2300/0852; G09G 2300/0819; G09G 2300/0861; G09G 2300/0866
See application file for complete search history.

(56) References Cited

U.S. PATENT DOCUMENTS

2009/0243979 A1 10/2009 Kim
2012/0146999 A1* 6/2012 Hwang ..... G09G 3/003 345/419

(Continued)

FOREIGN PATENT DOCUMENTS

CN 101800024 A 8/2010
CN 102005182 A 4/2011

(Continued)

OTHER PUBLICATIONS

First Office Action dated Nov. 29, 2016 in corresponding Chinese Application No. 201510427812.9.

*Primary Examiner* — Kwang-Su Yang
(74) *Attorney, Agent, or Firm* — Nath, Goldberg & Meyer; Joshua B. Goldberg

(57) ABSTRACT

The present invention provides a pixel driving circuit, a driving method thereof, and a display device. The pixel driving circuit of the present invention comprises a data writing unit, a threshold compensation unit, a driving unit, a light-emitting unit, and a voltage stabilizing unit; the data writing unit is connected with a first node, a scan signal line and a data signal line; the first node is a connection node between the data writing unit and the driving unit; the threshold compensation unit is connected with the first node, a first control signal line, a first voltage terminal and the driving unit; the driving unit is connected with the light-emitting unit; and the voltage stabilizing unit is connected with the data writing unit, a second control signal line and the first voltage terminal.

17 Claims, 3 Drawing Sheets

(52) U.S. Cl.
CPC ..... *G09G 2300/0861* (2013.01); *G09G 2300/0866* (2013.01)

(56) References Cited

U.S. PATENT DOCUMENTS

| | | | | |
|---|---|---|---|---|
| 2013/0127818 | A1* | 5/2013 | Tsai | G09G 3/14 345/212 |
| 2014/0225878 | A1* | 8/2014 | Shih | G09G 3/3258 345/205 |
| 2014/0253612 | A1* | 9/2014 | Hwang | G09G 3/3258 345/691 |
| 2016/0203758 | A1* | 7/2016 | Tsuge | G09G 3/3258 345/211 |

FOREIGN PATENT DOCUMENTS

| | | | |
|---|---|---|---|
| CN | 102346999 | A | 2/2012 |
| CN | 102436793 | A | 5/2012 |
| CN | 102930824 | A | 2/2013 |
| CN | 103400552 | A | 11/2013 |
| CN | 104299570 | A | 1/2015 |
| CN | 104361857 | A | 2/2015 |

* cited by examiner

PIXEL DRIVING CIRCUIT FOR AVOIDING FLICKER OF LIGHT-EMITTING UNIT, DRIVING METHOD THEREOF, AND DISPLAY DEVICE

CROSS REFERENCE TO RELATED APPLICATION

The present application claims the benefit of Chinese Patent Application No. 201510427812.9 filed on Jul. 17, 2015 in China, the entire contents of which are herein incorporated by reference.

FIELD OF THE INVENTION

The present invention belongs to the field of display technology, and particularly relates to a pixel driving circuit, a driving method thereof, and a display device.

BACKGROUND OF THE INVENTION

Organic light-emitting diodes (OLEDs), as current mode light-emitting diodes, have been more and more applied to high-performance display. With an increase in display size, a traditional passive matrix OLED requires shorter driving time for a single pixel, which needs to increase transient current and power consumption. In the meanwhile, large current will lead to an excessively large voltage drop on an ITO line and an excessively high working voltage of an OLED, so that efficiency of the OLED will be reduced. However, such problems can be solved well in an active matrix OLED in which OLED currents are inputted by scanning switching transistors progressively.

In an AMOLED backplane design, a main problem to be solved is non-uniformity of brightness of pixels. FIG. 1 shows a structure of the most traditional voltage-driven type pixel driving circuit (2T1C) formed by two transistors and one capacitor. A switching transistor TFT1 transfers a voltage of a data signal line DATA to a control electrode of a driving transistor DTFT, and the driving transistor DTFT converts said data voltage to a corresponding current and supplies said current to an organic light-emitting diode OLED. In normal operation, the driving transistor DTFT should be in a saturation region, and supplies a constant current within scanning time of one row. The current can be represented by the following formula:

$$I_{OLED} = \frac{1}{2}\mu_n \cdot Cox \cdot \frac{W}{L} \cdot (V_{DATA} - V_{OLED} - V_{thn})^2$$

where, $\mu_n$ is carrier mobility, $C_{ox}$ is a gate oxide layer capacitance, W/L is a width to length ratio of transistor, $V_{DATA}$ is a data voltage, $V_{OLED}$ is a working voltage of organic light-emitting diode OLED and is shared by all pixel units, $V_{thn}$ is a threshold voltage of driving transistor, and $V_{thn}$ is a positive value in the case of an enhancement-mode transistor, and is a negative value in the case of a depletion-mode transistor. However, if the threshold voltages $V_{thn}$ of different pixel units are different, the currents are difference. If the threshold voltage $V_{thn}$ of a pixel unit shifts over time, the current thereof may vary over time, which results in afterimage. Moreover, different working voltages of the organic light-emitting diodes OLED due to non-uniformity of the organic light-emitting diodes OLED may also lead to different currents.

To solve the above problems, a threshold compensation unit is provided in the pixel driving circuit so as to compensate for the threshold voltage of the driving transistor DTFT. Nevertheless, the switching transistor TFT1 may still have a problem of electric leakage, which may cause a gate voltage of the driving transistor DTFT to vary when the data voltage changes, so that brightness of the organic light-emitting diode OLED changes over time, thereby resulting in flicker.

SUMMARY OF THE INVENTION

In view of the aforesaid problems existing in a conventional pixel driving circuit, a technical problem to be solved by the present invention includes providing a pixel driving circuit, a driving method thereof and a display device, which can avoid voltage jump and flicker of an organic light-emitting diode caused by a change of a data signal and electric leakage of a switching transistor.

A technical solution employed to solve the technical problem of the present invention is a pixel driving circuit, comprising a data writing unit, a threshold compensation unit, a driving unit, a light-emitting unit, and a voltage stabilizing unit; wherein, the data writing unit is connected with a first node, a scan signal line and a data signal line, and is used for controlling whether to input a data signal inputted into the data signal line into the driving unit according to a scan signal inputted into the scan signal line; the first node is a connection node between the data writing unit and the driving unit;

the threshold compensation unit is connected with the first node, a first control signal line, a first voltage terminal and the driving unit, and is used for compensating for a threshold voltage of the driving unit according to a first control signal inputted into the first control signal line;

the driving unit is connected with the light-emitting unit, and is used for driving the light-emitting unit to emit light according to the data signal provided by the data writing unit; and the voltage stabilizing unit is connected with the data writing unit, a second control signal line and the first voltage terminal, and is used for stabilizing a potential at the first node according to a second control signal inputted into the second control signal line.

Optionally, the voltage stabilizing unit comprises a third transistor and a second storage capacitor; wherein, a first electrode of the third transistor is connected with a second terminal of the second storage capacitor, a second electrode of the third transistor is connected with the first node, and a control electrode of the third transistor is connected with the second control signal line; and a first terminal of the second storage capacitor is connected with the first voltage terminal.

Optionally, the data writing unit comprises a first transistor; wherein, a first electrode of the first transistor is connected with the data signal line, a second electrode of the first transistor is connected with the first node, and a control electrode of the first transistor is connected with the scan signal line.

Optionally, the threshold compensation unit comprises a second transistor and a first storage capacitor; wherein, a first electrode of the second transistor is connected with the first voltage terminal, a second electrode of the second transistor is connected with the driving unit, and a control electrode of the second transistor is connected with the first control signal line; and a first terminal of the first storage capacitor is connected with the first node, and a second terminal of the first storage capacitor is connected with a second node; and the second node is a connection node between the driving unit and the light-emitting unit.

Alternatively, the threshold compensation unit is further connected with a third control signal line, and is used for compensating for the threshold voltage of the driving unit according to the first control signal inputted into the first control signal line and a third control signal inputted into the third control signal line; and the threshold compensation unit comprises a second transistor, a fourth transistor, a first storage capacitor and a third storage capacitor; wherein, a first electrode of the second transistor is connected with the first voltage terminal, a second electrode of the second transistor is connected with the driving unit, and a control electrode of the second transistor is connected with the first control signal line;

a first terminal of the first storage capacitor is connected with the first node, and a second terminal of the first storage capacitor is connected with a second node; the second node is a connection node between the driving unit and the light-emitting unit;

a first electrode of the fourth transistor is connected with a third voltage terminal, a second electrode of the fourth transistor is connected with the second node, and a control electrode of the fourth transistor is connected with the third control signal line; and a first terminal of the third storage capacitor is connected with the first voltage terminal, and a second terminal of the third storage capacitor is connected with the second node.

Optionally, the light-emitting unit is an organic light-emitting diode; wherein, an anode of the organic light-emitting diode is connected with the driving unit, and a cathode of the organic light-emitting diode is connected with a second voltage terminal.

Optionally, the driving unit comprises a driving transistor; wherein, a first electrode of the driving transistor is connected with the threshold compensation unit, a second electrode of the driving transistor is connected with the light-emitting unit, and a control electrode of the driving transistor is connected with the first node.

A technical solution employed to solve the technical problem of the present invention is a driving method of a pixel driving circuit, wherein the pixel driving circuit comprises a data writing unit, a threshold compensation unit, a driving unit, a light-emitting unit, and a voltage stabilizing unit; and the driving method comprises:

a reset stage: in which a reset signal is inputted, and the driving unit and the light-emitting unit are reset;

a threshold acquisition stage: in which a threshold voltage compensation signal is inputted, and a threshold voltage of the driving unit is acquired;

a data writing stage: in which a scan signal is inputted into a scan signal line, a data signal inputted into a data signal line and the threshold voltage are superimposed and written into the driving unit;

a light emission for display stage: in which a light emission control signal is inputted into a first control signal line, and the driving unit drives the light-emitting unit; and a voltage stabilization stage: in which a voltage stabilization control signal is inputted into a second control signal line, and a potential at a first node is stabilized by the voltage stabilizing unit, the first node being a connection node between the data writing unit and the driving unit.

Optionally, the data writing unit comprises a first transistor; the threshold compensation unit comprises a second transistor and a first storage capacitor; the light-emitting unit is an organic light-emitting diode; the voltage stabilizing unit comprises a third transistor and a second storage capacitor; the driving unit comprises a driving transistor; and the driving method specifically comprises:

in the reset stage, inputting the scan signal into the scan signal line, inputting the reset signal into the first control signal line, and inputting a reference voltage to the data signal line to turn on the first transistor, the second transistor and the driving transistor, and applying a low level to a first voltage terminal, so that an anode of the organic light-emitting diode is reset;

in the threshold acquisition stage, inputting a threshold voltage acquisition signal into the first control signal line, and inputting the scan signal into the scan signal line to turn on the first transistor and the second transistor, and storing, in the first capacitor, the threshold voltage of the driving transistor, which is equal to a difference between the potential at the first node and a potential at a second node, so as to acquire the threshold voltage of the driving transistor, the second node being a connection node between the driving unit and the light-emitting unit;

in the data writing stage, inputting the scan signal into the scan signal line to turn on the first transistor, and turning off the second transistor, so that the data signal inputted into the data signal line and the threshold voltage stored in the first storage capacitor are written to a control electrode of the driving transistor;

in the light emission for display stage, inputting the light emission control signal into the first control signal line, turning on the second transistor and the driving transistor are turned on, and applying a high level to the first voltage terminal, so that the organic light-emitting diode is driven to emit light; and in the voltage stabilization stage, inputting the voltage stabilization control signal into the second control signal line to turn on the third transistor, and applying a high level to the first voltage terminal, so that the potential at the first node is stabilized through the second storage capacitor.

Alternatively, the data writing unit comprises a first transistor; the threshold compensation unit comprises a second transistor, a fourth transistor, a first storage capacitor and a third storage capacitor; the light-emitting unit is an organic light-emitting diode; the voltage stabilizing unit comprises a third transistor and a second storage capacitor; the driving unit comprises a driving transistor; and the driving method specifically comprises:

in the reset stage, inputting the scan signal into the scan signal line, inputting the reset signal into a third control signal line, and applying a reference voltage to the data signal line to turn on the first transistor, the fourth transistor and the driving transistor, and inputting a DC low level signal into a third voltage terminal, so that an anode of the organic light-emitting diode is reset;

in the threshold acquisition stage, inputting a threshold voltage acquisition signal into the first control signal line, and inputting the scan signal into the scan signal line to turn on the first transistor and the second transistor, and storing, in the first storage capacitor, the threshold voltage of the driving transistor, which is equal to a difference between the potential at the first node and a potential at a second node, so as to acquire the threshold voltage of the driving transistor, the second node being a connection node between the driving unit and the light-emitting unit;

in the data writing stage, inputting the scan signal into the scan signal line to turn on the first transistor, and turning off the second transistor, so that the data signal inputted into the data signal line and the threshold voltage stored in the first storage capacitor are written to a control electrode of the driving transistor;

in the light emission for display stage, inputting the light emission control signal into the first control signal line, turning on the second transistor and the driving transistor, and applying a high level to the first voltage terminal, so that the organic light-emitting diode is driven to emit light; and in the voltage stabilization stage, inputting the voltage stabilization control signal into the second control signal line to turn on the third transistor, and applying a high level to the first voltage terminal, so that the potential at the first node is stabilized through the second storage capacitor.

A technical solution employed to solve the technical problem of the present invention is a display device, comprising the aforesaid pixel driving circuit.

The present invention has the following beneficial effects:

the pixel driving circuit of the present invention comprises not only a threshold compensation unit that can compensate for a threshold voltage of a driving unit of the pixel driving circuit, but also a voltage stabilizing unit that can, even in the presence of electric leakage of a data writing unit, stabilize a potential at a first node A under the control of a second control signal (a voltage stabilization control signal) inputted into a second control signal line, so as to avoid flicker of a light-emitting unit resulted from change in voltage outputted from the driving unit due to the electric leakage of the data writing unit.

The display device of the present invention comprises the aforesaid pixel driving circuit, and therefore can eliminate the aforesaid problem of flicker.

The driving method of a pixel driving circuit of the present invention can solve the problem of voltage jump and flicker of an organic light-emitting diode caused by a change of a data signal and electric leakage of a switching transistor

DETAILED DESCRIPTION OF THE EMBODIMENTS

In order to make those skilled in the art better understand the technical solutions of the present invention, the present invention will be further described in detail below with reference to the accompanying drawings and specific implementations.

Transistors adopted in embodiments of the present invention may be thin film transistors, or field effect transistors, or other diodes having like characteristics. Since a source and a drain of the adopted transistor are symmetrical, there is no difference between the source and the drain. In the embodiments of the present invention, to distinguish the source of the transistor from the drain thereof, the source is called a first electrode, the drain is called a second electrode, and a gate is called a control electrode; or, the drain is called a first electrode, and the source is called a second electrode. In addition, transistors can be classified into N-type transistors and P-type transistors according to characteristics thereof, and N-type transistors are taken as an example in the following embodiments. In the case of adopting N-type transistors, a first electrode is the source of the N-type transistor, a second electrode is the drain of the N-type transistor, and the source and the drain are conducted when a high level is applied to a gate; and the opposite is the case for P-type transistors. An implementation by adopting P-type transistors can be easily conceived by those skilled in the art without involving any inventive effort, and therefore falls into the protection scope of the embodiments of the present invention.

Embodiment 1

Figure 1:
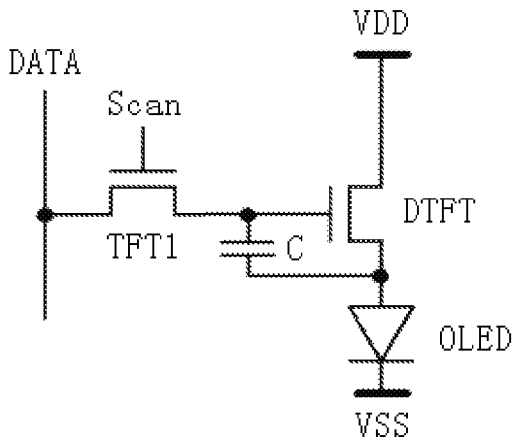
Fig. 1 (Prior Art)
FIG. 1 is a circuit diagram of a conventional pixel driving circuit.
Figure 2:
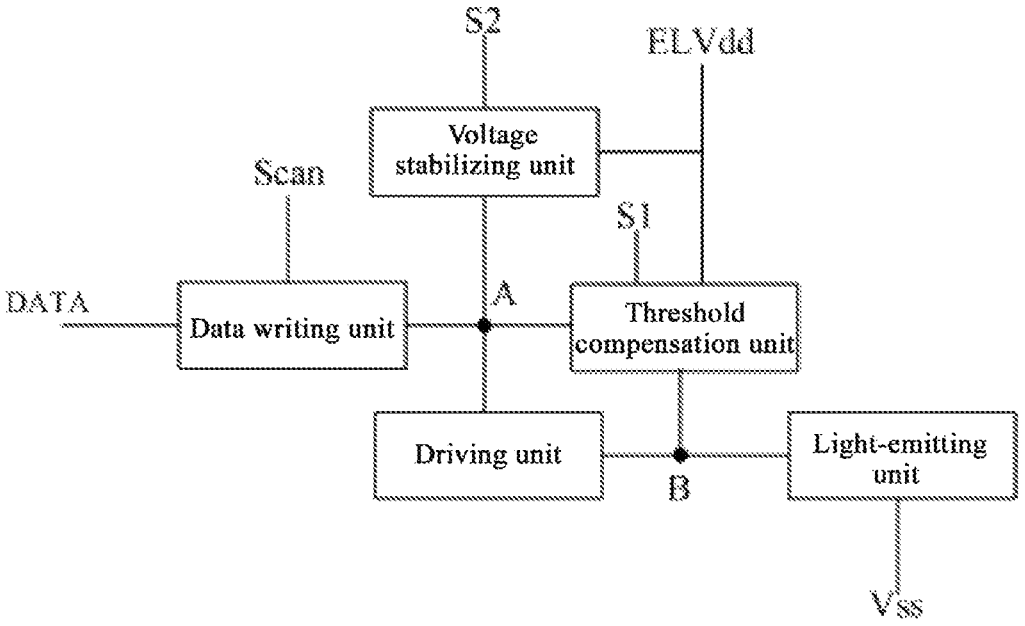
FIG. 2 is a schematic diagram of a pixel driving circuit provided in Embodiment 1 of the present invention.

As shown in FIG. 2, this embodiment provides a pixel driving circuit, comprising a data writing unit, a threshold compensation unit, a driving unit, a light-emitting unit, and a voltage stabilizing unit; wherein, the data writing unit is connected with a first node A, a scan signal line Scan and a data signal line DATA, and is used for controlling whether to input a data signal inputted into the data signal line into the driving unit according to a scan signal inputted into the scan signal line Scan; the first node A is a connection node between the data writing unit and the driving unit; the threshold compensation unit is connected with the first node A, a first control signal line S1, a first voltage terminal ELVdd and the driving unit, and is used for compensating for a threshold voltage of the driving unit according to a first control signal inputted into the first control signal line S1; the driving unit is connected with the light-emitting unit, and is used for driving the light-emitting unit to emit light according to the data signal provided by the data writing unit; and the voltage stabilizing unit is connected with the data writing unit, a second control signal line S2 and the first voltage terminal ELVdd, and is used for stabilizing potential at the first node A according to a second control signal inputted into the second control signal line S2.

The pixel driving circuit in this embodiment comprises not only the threshold compensation unit that can compensate for the threshold voltage of the driving unit of the pixel driving circuit, but also the voltage stabilizing unit that can, even in the presence of electric leakage of the data writing unit, stabilize the potential at the first node A under the control of the second control signal (a voltage stabilization control signal) inputted into the second control signal line S2, so as to avoid flicker of the light-emitting unit resulted from change in voltage outputted from the driving unit due to the electric leakage of the data writing unit.

Figure 3:
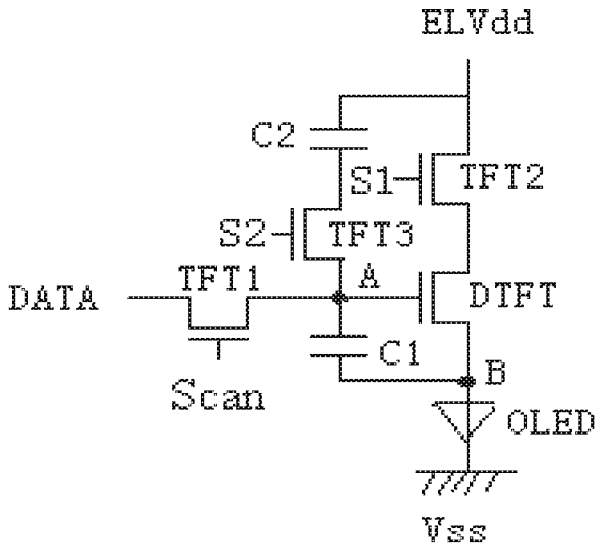
FIG. 3 is a circuit diagram of a pixel driving circuit provided in Embodiment 1 and Embodiment 2 of the present invention.

Specifically, with reference to FIG. 3, the data writing unit comprises a first transistor TFT1; a first electrode of the first transistor TFT1 is connected with the data signal line DATA, a second electrode of the first transistor TFT1 is connected with the first node A, and a control electrode of the first transistor TFT1 is connected with the scan signal line Scan. That is to say, when a high level signal is inputted into the scan signal line Scan, the first transistor TFT1 is turned on, the data signal on the data signal line DATA is transferred to the first node A at this moment, and the potential at the first node A is higher than the threshold voltage of a driving transistor DTFT.

Specifically, the threshold compensation unit comprises a second transistor TFT2 and a first storage capacitor C1; a first electrode of the second transistor TFT2 is connected with the first voltage terminal ELVdd, a second electrode of the second transistor TFT2 is connected with the driving unit, and a control electrode of the second transistor TFT2 is connected with the first control signal line S1; a first terminal of the first storage capacitor is connected with the first node A, and a second terminal of the first storage capacitor is connected with a second node B; and the second node B is a connection node between the driving unit and the light-emitting unit. That is to say, when a threshold voltage compensation signal (a high level signal) is inputted into the first control signal line S1, the second transistor TFT2 is turned on, and the driving transistor DTFT is also turned on because the potential at the first node A is higher than its threshold voltage, so that a high level signal inputted into the first voltage terminal ELVdd discharges electricity to the second node B until a potential $V_B$ at the second node B satisfies $V_B=V_A-V_{th}$, where, $V_A$ is the potential at the first node A, and $V_{th}$ is the threshold voltage of the driving transistor DTFT. At this moment, a voltage across two terminals of the first storage capacitor C1 between the second node B and the first node A is equal to $V_{th}$.

It should be noted that the threshold compensation unit is not limited to the above implementation, and may adopt other configuration as long as it can compensate for the threshold voltage of the driving unit.

Specifically, the light-emitting unit is an organic light-emitting diode OLED; an anode of the organic light-emitting diode OLED is connected with the driving unit, and a cathode of the organic light-emitting diode OLED is connected with a second voltage terminal Vss. That is to say, the organic light-emitting diode OLED can emit light for display when the driving unit is turned on.

Specifically, the voltage stabilizing unit comprises a third transistor TFT3 and a second storage capacitor C2; a first electrode of the third transistor TFT3 is connected with a second terminal of the second storage capacitor C2, a second electrode of the third transistor TFT3 is connected with the first node A, and a control electrode of the third transistor TFT3 is connected with the second control signal line; and a first terminal of the second storage capacitor is connected with the first voltage terminal ELVdd. That is to say, when the voltage stabilization control signal (a high level signal) is inputted into the second control signal line S2, the third transistor TFT3 is turned on, and the first terminal of the second storage capacitor C2 is connected with the first voltage terminal ELVdd into which a high level signal is inputted, so that the potential at the first node A can be stabilized through the second storage capacitor C2 at this moment.

Specifically, the driving unit comprises the driving transistor DTFT; wherein, a first electrode of the driving transistor DTFT is connected with the threshold compensation unit, a second electrode of the driving transistor DTFT is connected with the light-emitting unit, and a control electrode of the driving transistor DTFT is connected with the first node A. That is to say, when the potential at the node A is higher than or equal to the threshold voltage of the driving transistor DTFT, the driving transistor DTFT is turned on so as to control the light-emitting unit.

Embodiment 2

This embodiment provides a driving method of a pixel driving circuit, wherein the pixel driving circuit may be the pixel driving circuit provided in Embodiment 1. The specific driving method is described as follows.

The pixel driving circuit comprises a data writing unit, a threshold compensation unit, a driving unit, a light-emitting unit, and a voltage stabilizing unit; and the driving method comprises:

a reset stage: in which a reset signal is inputted, and the driving unit and the light-emitting unit are reset;

a threshold acquisition stage: in which a threshold acquisition signal is inputted into a first control signal line, a reference voltage signal is inputted into a data signal line, and a threshold voltage of the driving unit is acquired;

a data writing stage: in which a scan signal is inputted into a scan signal line Scan, the data signal inputted into the data signal line DATA and the threshold voltage are superimposed and written into the driving unit;

a light emission for display stage: in which a light emission control signal is inputted into the first control signal line S1, and the driving unit drives the light-emitting unit; and a voltage stabilization stage: in which a voltage stabilization control signal is inputted into a second control signal line S2, and a potential at a first node A is stabilized by the voltage stabilizing unit.

As shown in FIG. 3, the data writing unit comprises a first transistor TFT1; the threshold compensation unit comprises a second transistor TFT2 and a first storage capacitor C1; the light-emitting unit is an organic light-emitting diode OLED; the voltage stabilizing unit comprises a third transistor TFT3 and a second storage capacitor C2; and the driving unit comprises a driving transistor DTFT. A first electrode of the first transistor TFT1 is connected with the data signal line DATA, a second electrode of the first transistor TFT1 is connected with the first node A, and a control electrode of the first transistor TFT1 is connected with the scan signal line Scan; a first electrode of the second transistor TFT2 is connected with a first voltage terminal ELVdd, a second electrode of the second transistor TFT2 is connected with a first electrode of the driving transistor DTFT, and a control electrode of the second transistor TFT2 is connected with the first control signal line S1; a first terminal of the first storage capacitor C1 is connected with the first node A, and a second terminal of the first storage capacitor C1 is connected a second node B; an anode of the organic light-emitting diode OLED is connected with a second electrode of the driving transistor DTFT, and a cathode of the organic light-emitting diode OLED is connected with a second voltage terminal Vss; a first electrode of the third transistor TFT3 is connected with a second terminal of the second storage capacitor C2, a second electrode of the third transistor TFT3 is connected with the first node A, and a control electrode of the third transistor TFT3 is connected with the second control signal line; a first terminal of the second storage capacitor C2 is connected with the first voltage terminal ELVdd; and the first electrode of the driving transistor DTFT is connected with the second electrode of the second transistor TFT2, the second electrode of the driving transistor DTFT is connected with the light-emitting unit, and a control electrode of the driving transistor DTFT is connected with the first node A.

Figure 4:
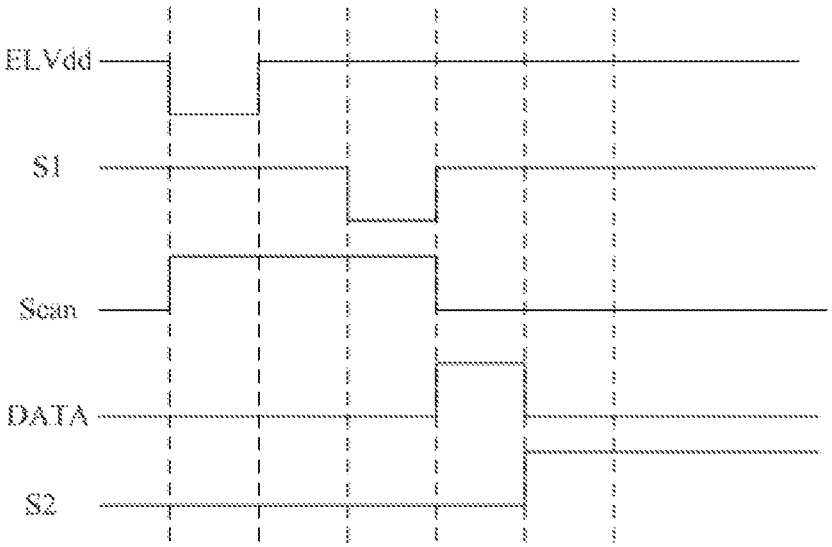
FIG. 4 is a drive timing diagram of the pixel driving circuit shown in FIG. 3.

With reference to the timing diagram in FIG. 4, the driving method of the pixel driving circuit is described in detail as follows.

In the reset stage, the scan signal is inputted into the scan signal line Scan, the reset signal is inputted into the first control signal line S1, and a reference voltage is applied to the data signal line DATA, so that the first transistor TFT1, the second transistor TFT2 and the driving transistor DTFT are turned on, and a low level is applied to the first voltage terminal ELVdd, to reset the anode of the organic light-emitting diode. Specifically, a first control signal (i.e., the reset signal) inputted into the first control signal line S1 has a high level, and the scan signal inputted into the scan signal line Scan also has a high level, so that both the first transistor TFT1 and the second transistor TFT2 are turned on, whereas the data signal inputted into the data signal line DATA is a reference voltage signal, that is, the potential at the first node A is equal to the reference voltage which is higher than the threshold voltage of the driving transistor DTFT, so that the driving transistor DTFT is turned on, in the meanwhile, a low level is applied to the first voltage terminal ELVdd to reset the anode of the organic light-emitting diode, and as a result, the organic light-emitting diode OLED shows a dark state and does not emit light before the threshold acquisition stage and the data writing stage.

In the threshold acquisition stage, a threshold voltage acquisition signal is inputted into the first control signal line S1, the first transistor TFT1 and the second transistor TFT2 are turned on, and the threshold voltage of the driving transistor DTFT, which is equal to a difference between the potential at the first node A and a potential at the second node B, is stored in the first storage capacitor C1, so as to acquire the threshold voltage of the driving transistor DTFT. Specifically, the first control signal (i.e., the threshold voltage acquisition signal) inputted into the first control signal line S1 is a high level signal, so that the second transistor TFT2 is turned on, the data signal inputted into the data signal line DATA is the reference voltage signal, that is, the potential at the first node A is equal to the reference voltage, so that the driving transistor DTFT is also turned on, therefore, a high level signal inputted into the first voltage terminal ELVdd discharges electricity to the second node B to gradually increase the potential at the second node B until the potential $V_B$ at the second node B satisfies $V_B=V_A-V_{th}$, where, $V_A$ is the potential at the first node A, and $V_{th}$ is the threshold voltage of the driving transistor DTFT. At this moment, $V_{th}$ is stored in the first storage capacitor C1 between the second node B and the first node A.

In the data writing stage, the scan signal is inputted into the scan signal line Scan, so that the first transistor TFT1 is turned on, the second transistor TFT2 is turned off, and the data signal inputted into the data signal line DATA is written to the gate of the driving transistor DTFT. Specifically, a high level signal is inputted into the scan signal line Scan, so that the first transistor TFT1 is turned on, and the data signal on the data signal line DATA is transferred to the first node A at this moment, that is, to the gate (the control electrode) of the driving transistor DTFT, and the source (the second electrode) of the driving transistor DTFT, that is, the second node B, changes as the voltage at the first node A changes due to coupling of the storage capacitor, while the voltage between the first node A and the second node B is still equal to $V_{th}$.

In the light emission for display stage, the scan signal inputted into the scan signal line Scan has a low level, so that the first transistor TFT1 is turned off, the light emission control signal is inputted into the first control signal line S1, the second transistor TFT2 and the driving transistor DTFT are turned on, and a high level is applied to the first voltage terminal ELVdd, so that the organic light-emitting diode OLED is driven to emit light, thereby achieving display. Specifically, the light emission control signal is inputted into the first control signal line, that is, the first control signal has a high level, because the data signal in the previous stage and the threshold voltage stored in the first capacitor C1 in the previous stage are written to the control electrode of the driving transistor DTFT, the voltage of the control electrode of the driving transistor DTFT is higher than the threshold voltage of the driving transistor DTFT, so that the driving transistor DTFT is turned on, and a high level signal is inputted into the first voltage terminal ELVdd, so that the organic light-emitting diode OLED is driven to emit light, thereby achieving display. At this moment, a current $I_{OLED}$ flowing through the organic light-emitting diode OLED satisfies $I_{OLED}=k(V_A-V_B-V_{th})^2=k\alpha(V_{DATA}-V_0)^2$, where, $V_{DATA}$ is the data voltage written to the data signal line DATA, $\alpha$ is a constant related to the first storage capacitor C1, k is a constant related to characteristics of the driving transistor DTFT, and $V_0$ is the reference voltage provided by the data signal line DATA in the reset stage and the threshold acquisition stage.

In the voltage stabilization stage, the voltage stabilization control signal is inputted into the second control signal line, so that the third transistor TFT3 is turned on, a high level is applied to the first voltage terminal ELVdd, and the potential at the first node A is stabilized through the second storage capacitor C2. Specifically, the second control signal inputted into the second control signal line in each of the aforesaid stages has a low level, so that the third transistor TFT3 is always turned off, that is to say, the second terminal of the second storage capacitor C2 is always floating. In this stage, the voltage stabilization control signal is inputted into the second control signal line, that is, the second control signal has a high level, so that the third transistor TFT3 is turned on, the first terminal of the second storage capacitor C2 is connected with the first voltage terminal ELVdd into which a high level signal is inputted, and the potential at the first node A can be stabilized through the second storage capacitor C2 at this moment. As a result, flicker due to difference between brightness of the organic light-emitting diode OLED which happens when a gate voltage of the driving transistor DTFT is changed because of electric leakage of the first transistor TFT1 and a change of the data signal can be avoided.

Embodiment 3

This embodiment also provides a pixel driving circuit, whose configuration is substantially the same as that in Embodiment 1, but differs in that the threshold compensation unit is further connected with a third control signal line. Specific configuration of the threshold compensation unit is different from that of the threshold compensation unit in Embodiment 1. The threshold compensation unit in this embodiment comprises a second transistor, a fourth transistor TFT4, a first storage capacitor and a third storage capacitor C3. Connection relations in the pixel driving circuit in this embodiment are specifically described as follows.

Figure 5:
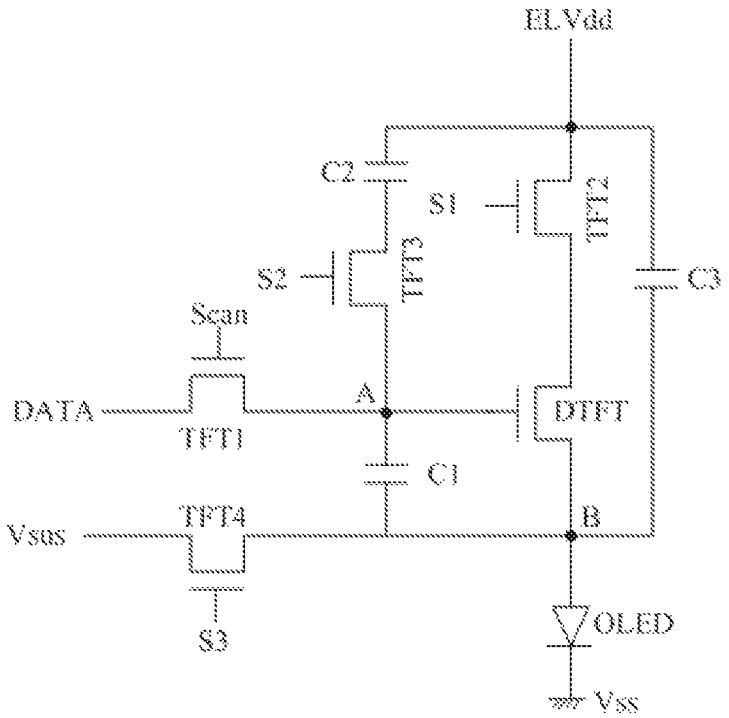
FIG. 5 is a circuit diagram of a pixel driving circuit provided in Embodiment 3 of the present invention.

As shown in FIG. 5, the data writing unit comprises a first transistor TFT1; the threshold compensation unit comprises a second transistor TFT2, a fourth transistor TFT4, a first storage capacitor C1 and a third storage capacitor C3; the light-emitting unit is an organic light-emitting diode OLED; the voltage stabilizing unit comprises a third transistor TFT3 and a second storage capacitor C2; and the driving unit comprises a driving transistor DTFT. A first electrode of the first transistor TFT1 is connected with the data signal line DATA, a second electrode of the first transistor TFT1 is connected with the first node A, and a control electrode of the first transistor TFT1 is connected with the scan signal line Scan; a first electrode of the second transistor TFT2 is connected with a first voltage terminal ELVdd, a second electrode of the second transistor TFT2 is connected with a first electrode of the driving transistor DTFT, and a control electrode of the second transistor TFT2 is connected with the first control signal line S1; a first terminal of the first storage capacitor C1 is connected with the first node A, and a second terminal of the first storage capacitor C1 is connected with a second node B; an anode of the organic light-emitting diode OLED is connected with a second electrode of the driving transistor DTFT, and a cathode of the organic light-emitting diode OLED is connected with a second voltage terminal Vss; a first electrode of the fourth transistor TFT4 is connected with a third voltage terminal Vsus, a second electrode of the fourth transistor TFT4 is connected with the second node B, and a control electrode of the fourth transistor TFT4 is connected with the third control signal line; a first terminal of the third storage capacitor C3 is connected with the first voltage terminal, and a second terminal of the third storage capacitor C3 is connected the second node B; a first electrode of the third transistor TFT3 is connected with a second terminal of the second storage capacitor C2, a second electrode of the third transistor TFT3 is connected with the first node A, and a control electrode of the third transistor TFT3 is connected with the second control signal line; a first terminal of the second storage capacitor C2 is connected with the first voltage terminal ELVdd; the first electrode of the driving transistor DTFT is connected with the second electrode of the second transistor TFT2, the second electrode of the driving transistor DTFT is connected with the light-emitting unit, and a control electrode of the driving transistor DTFT is connected with the first node A; the first terminal of the first storage capacitor C1 is connected with the first node A, and the second terminal of the first storage capacitor C1 is connected with the second node B; and the second node B is a connection node between the driving unit and the light-emitting unit.

Figure 6:
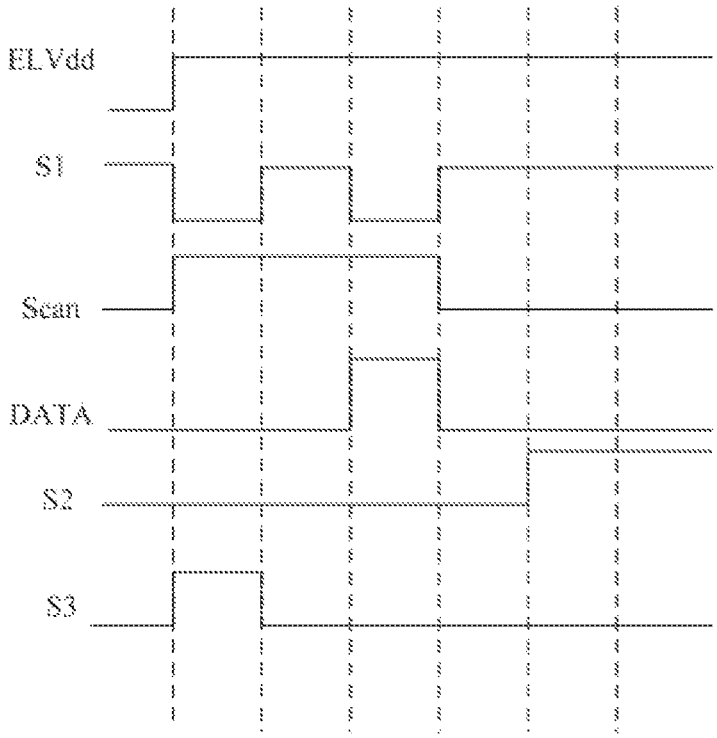
FIG. 6 is a drive timing diagram of the pixel driving circuit shown in FIG. 5.

With reference to the timing diagram in FIG. 6, the driving method of the pixel driving circuit is described in detail as follows.

In the reset stage, the scan signal is inputted into the scan signal line Scan, the reset signal is inputted into the third control signal line, a reference voltage is applied to the data signal line DATA, a DC low level signal is inputted into the third voltage terminal Vsus, so that the first transistor TFT1, the second transistor TFT2 and the driving transistor DTFT are turned on, and a low level is applied to the first voltage terminal ELVdd, so that the anode of the organic light-emitting diode is reset. Specifically, a third control signal inputted into the third control signal line has a high level, and the scan signal inputted into the scan signal line Scan also has a high level, so that both the first transistor TFT1 and the fourth transistor TFT4 are turned on, while the data signal inputted into the data signal line DATA is a reference voltage signal, that is, the potential at the first node A is equal to the reference voltage which is higher than the threshold voltage of the driving transistor DTFT, so that the driving transistor DTFT is turned on, in this stage, a potential at the second node B is pulled down because the DC low level signal is inputted into the third voltage terminal Vsus, so that the anode of the organic light-emitting diode is reset, and as a result, the organic light-emitting diode OLED shows a dark state and does not emit light before the threshold acquisition stage and the data writing stage.

In the threshold acquisition stage, a threshold voltage acquisition signal is inputted into the first control signal line S1, the first transistor TFT1 and the second transistor TFT2 are turned on, and the threshold voltage of the driving transistor DTFT, which is equal to a difference between the potential at the first node A and the potential at the second node B, is stored in the first storage capacitor C1, so as to acquire the threshold voltage of the driving transistor DTFT. Specifically, a low level signal is inputted into the third control signal line, so that the fourth transistor TFT4 is turned off, the first control signal inputted into the first control signal line S1 is a high level signal, so that the second transistor TFT2 is turned on, the data signal inputted into the data signal line DATA is the reference voltage signal, that is, the potential at the first node A is equal to the reference voltage, and the driving transistor DTFT is also turned on, so that a high level signal inputted into the first voltage terminal ELVdd discharges electricity to the second node B to gradually increase the potential at the second node B until the potential $V_B$ at the second node B satisfies $V_B=V_A-V_{th}$, where, $V_A$ is the potential at the first node A, and $V_{th}$ is the threshold voltage of the driving transistor DTFT. At this moment, a voltage across two terminals of the first storage capacitor C1 between the second node B and a node C is equal to $V_{th}$.

In the data writing stage, the scan signal is inputted into the scan signal line Scan, so that the first transistor TFT1 is turned on, the second transistor TFT2 is turned off, and the data signal inputted into the data signal line DATA is written to the gate of the driving transistor DTFT. Specifically, a high level signal is inputted into the scan signal line Scan, so that the first transistor TFT1 is turned on, and the data signal of the data signal line DATA is transferred to the first node A at this moment, that is, to the gate of the driving transistor DTFT, and accordingly, a source of the driving transistor DTFT, that is, the second node B, changes as the voltage at the first node A changes due to coupling of the storage capacitor, while the voltage between the first node A and the second node B is still equal to $V_{th}$. At this moment, the potential $V_B$ at the second node B satisfies $V_B=V_A-V_{th}+a(V_{DATA}-V_A)$; $a=C1/(C1+C2)$.

In the light emission for display stage, the scan signal inputted into the scan signal line Scan has a low level, so that the first transistor TFT1 is turned off, the light emission control signal is inputted into the first control signal line S1, the second transistor TFT2 and the driving transistor DTFT are turned on, and a high level is applied to the first voltage terminal ELVdd, so that the organic light-emitting diode OLED is driven to emit light, thereby achieving display. Specifically, the light emission control signal is inputted into the first control signal line, that is, the first control signal has a high level, because the data signal in the previous stage and the threshold voltage stored in the first capacitor C1 in the previous stage are written to the control electrode of the driving transistor DTFT, the voltage at the control electrode of the driving transistor DTFT is higher than the threshold voltage of the driving transistor DTFT, so that the driving transistor DTFT is turned on, a high level signal is inputted into the first voltage terminal ELVdd, and the organic light-emitting diode OLED is thus driven to emit light, thereby achieving display. At this moment, a current $I_{OLED}$ flowing through the organic light-emitting diode OLED satisfies $I_{OLED}=k(V_A-V_B-V_{th})^2=k\alpha(V_{DATA}-V_0)^2$, where, $V_{DATA}$ is the data voltage written to the data signal line DATA, $\alpha$ is a constant related to the first storage capacitor C1, k is a constant related to characteristics of the driving transistor DTFT, and $V_0$ is the reference voltage provided by the data signal line DATA in the reset stage and the threshold acquisition stage.

In the voltage stabilization stage, the voltage stabilization control signal is inputted into the second control signal line, so that the third transistor TFT3 is turned on, and a high level is applied to the first voltage terminal ELVdd, so that the potential at the first node A is stabilized through the second storage capacitor C2. Specifically, the second control signal inputted into the second control signal line in each of the aforesaid stages has a low level, so that the third transistor TFT3 is always turned off, that is to say, the second terminal of the second storage capacitor C2 is always floating. In this stage, the voltage stabilization control signal is inputted into the second control signal line, that is, the second control signal has a high level, so that the third transistor TFT3 is turned on, the first terminal of the second storage capacitor C2 is connected with the first voltage terminal ELVdd, into which a high level signal is inputted, and the potential at the first node A can thus be stabilized through the second storage capacitor C2 at this moment. As a result, flicker due to difference between brightness of the organic light-emitting diode OLED which happens when a voltage of the gate (the control electrode) of the driving transistor DTFT is changed because of electric leakage of the first transistor TFT1 and a change of the data signal can be avoided.

Embodiment 4

This embodiment provides a display device, comprising any one of the pixel driving circuits provided in Embodiments 1 to 3. The display device comprises the aforesaid pixel driving circuit.

The display device may be any product or component having a display function, such as electronic paper, a mobile phone, a tablet computer, a TV set, a monitor, a notebook computer, a digital photo frame, a navigator, or the like.

By adopting the pixel driving circuits provided in Embodiments 1 to 3 which have good stability, uniformity of brightness of organic light-emitting diodes can be ensured, which correspondingly improves display quality of the display device, and helps to manufacture flat panel display devices having high reliability and low cost, thereby being more suitable for mass production.

It can be understood that the foregoing implementations are merely exemplary implementations adopted for describing the principle of the present invention, but the present invention is not limited thereto. Those of ordinary skill in the art can make various variations and improvements without departing from the spirit and essence of the present invention, and these variations and improvements shall be considered to fall into the protection scope of the present invention.

The invention claimed is:

1. A pixel driving circuit comprising: a data writing sub-circuit; a threshold compensation sub-circuit; a driving sub-circuit; a light-emitting sub-circuit; and a voltage stabilizing sub-circuit, wherein the data writing sub-circuit is connected with a first node, a scan signal line and a data signal line, and is used for controlling whether to input a data signal inputted into the data signal line into the driving sub-circuit according to a scan signal inputted into the scan signal line; the first node is a connection node between the data writing sub-circuit and the driving sub-circuit, the threshold compensation sub-circuit is connected with the first node, a first control signal line, a first voltage terminal and the driving sub-circuit, and is used for compensating for a threshold voltage of the driving sub-circuit according to a first control signal inputted into the first control signal line, the driving sub-circuit is connected with the light-emitting sub-circuit, and is used for driving the light-emitting sub-circuit to emit light according to the data signal provided by the data writing sub-circuit, and the voltage stabilizing sub-circuit comprises a first transistor and a first storage capacitor, a first electrode of the first transistor being connected with a second terminal of the first storage capacitor, a second electrode of the first transistor being connected with the first node, the second terminal of the first storage capacitor being connected only to the first electrode of the first transistor without being connected to any other element, and a control electrode of the first transistor being connected with a second control signal line, and is configured to stabilize a potential at the first node according to a second control signal inputted into the second control signal line and cause the second terminal of the first storage capacitor to be floated when the first transistor is turned off by the second control signal.

2. The pixel driving circuit of claim 1, wherein the data writing sub-circuit comprises a second transistor, and wherein a first electrode of the second transistor is connected with the data signal line, a second electrode of the second transistor is connected with the first node, and a control electrode of the second transistor is connected with the scan signal line.

3. The pixel driving circuit of claim 2, wherein the threshold compensation sub-circuit comprises a third transistor and a second storage capacitor, wherein a first electrode of the third transistor is connected with the first voltage terminal, a second electrode of the third transistor is connected with the driving sub-circuit, and a control electrode of the third transistor is connected with the first control signal line, and wherein a first terminal of the second storage capacitor is connected with the first node, and a second terminal of the second storage capacitor is connected with a second node; and the second node is a connection node between the driving sub-circuit and the light-emitting sub-circuit.

4. The pixel driving circuit of claim 2, wherein the threshold compensation sub-circuit is further connected with a third control signal line, and is used for compensating for the threshold voltage of the driving sub-circuit according to the first control signal inputted into the first control signal line and a third control signal inputted into the third control signal line, and the threshold compensation sub-circuit comprises a third transistor, a fourth transistor, a second storage capacitor and a third storage capacitor, wherein a first electrode of the third transistor is connected with the first voltage terminal, a second electrode of the third transistor is connected with the driving sub-circuit, and a control electrode of the third transistor is connected with the first control signal line, and wherein a first terminal of the second storage capacitor is connected with the first node, and a second terminal of the second storage capacitor is connected with a second node; the second node is a connection node between the driving sub-circuit and the light-emitting sub-circuit, a first electrode of the fourth transistor is connected with a third voltage terminal, a second electrode of the fourth transistor is connected with the second node, and a control electrode of the fourth transistor is connected with the third control signal line, and a first terminal of the third storage capacitor is connected with the first voltage terminal, and a second terminal of the third storage capacitor is connected with the second node.

5. The pixel driving circuit of claim 1, wherein the light-emitting sub-circuit is an organic light-emitting diode, and wherein an anode of the organic light-emitting diode is connected with the driving sub-circuit, and a cathode of the organic light-emitting diode is connected with a second voltage terminal.

6. The pixel driving circuit of claim 1, wherein the driving sub-circuit comprises a driving transistor, and wherein a first electrode of the driving transistor is connected with the threshold compensation sub-circuit, a second electrode of the driving transistor is connected with the light-emitting sub-circuit, and a control electrode of the driving transistor is connected with the first node.

7. A display device, comprising the pixel driving circuit of claim 1.

8. The display device of claim 7, wherein the data writing sub-circuit comprises a second transistor, and wherein a first electrode of the second transistor is connected with the data signal line, a second electrode of the second transistor is connected with the first node, and a control electrode of the second transistor is connected with the scan signal line.

9. The display device of claim 8, wherein the threshold compensation sub-circuit comprises a third transistor and a second storage capacitor, wherein a first electrode of the third transistor is connected with the first voltage terminal, a second electrode of the third transistor is connected with the driving sub-circuit, and a control electrode of the third transistor is connected with the first control signal line, and wherein a first terminal of the second storage capacitor is connected with the first node, and a second terminal of the second storage capacitor is connected with a second node; and the second node is a connection node between the driving sub-circuit and the light-emitting sub-circuit.

10. The display device of claim 8, wherein the threshold compensation sub-circuit is further connected with a third control signal line, and is used for compensating for the threshold voltage of the driving sub-circuit according to the first control signal inputted into the first control signal line and a third control signal inputted into the third control signal line, and the threshold compensation sub-circuit comprises a third transistor, a fourth transistor, a second storage capacitor and a third storage capacitor, and wherein a first electrode of the third transistor is connected with the first voltage terminal, a second electrode of the third transistor is connected with the driving sub-circuit, and a control electrode of the third transistor is connected with the first control signal line, a first terminal of the second storage capacitor is connected with the first node, and a second terminal of the second storage capacitor is connected with a second node; the second node is a connection node between the driving sub-circuit and the light-emitting sub-circuit, a first electrode of the fourth transistor is connected with a third voltage terminal, a second electrode of the fourth transistor is connected with the second node, and a control electrode of the fourth transistor is connected with the third control signal line, and a first terminal of the third storage capacitor is connected with the first voltage terminal, and a second terminal of the third storage capacitor is connected with the second node.

11. The display device of claim 7, wherein the light-emitting sub-circuit is an organic light-emitting diode, and wherein an anode of the organic light-emitting diode is connected with the driving sub-circuit, and a cathode of the organic light-emitting diode is connected with a second voltage terminal.

12. The display device of claim 7, wherein the driving sub-circuit comprises a driving transistor, and wherein a first electrode of the driving transistor is connected with the threshold compensation sub-circuit, a second electrode of the driving transistor is connected with the light-emitting sub-circuit, and a control electrode of the driving transistor is connected with the first node.

13. The pixel driving circuit of claim 1, wherein when the first transistor is turned on by the second control signal, the voltage stabilizing sub-circuit maintains the potential at the first node with a potential value at the first node before the first transistor is turned on.

14. A driving method of a pixel driving circuit, wherein the pixel driving circuit comprises a data writing sub-circuit, a threshold compensation sub-circuit, a driving sub-circuit, a light-emitting sub-circuit, and a voltage stabilizing sub-circuit comprising a first transistor and a first storage capacitor, a first electrode of the first transistor being connected with a second terminal of the first storage capacitor, the second terminal of the first storage capacitor being connected only to the first electrode of the first transistor without being connected to any other element, a second electrode of the first transistor being connected with a first node, and a control electrode of the first transistor being connected with a first control signal line, the driving method comprising:

in a reset stage, inputting a reset signal, and resetting the driving sub-circuit and the light-emitting sub-circuit;

in a threshold acquisition stage, inputting a threshold voltage compensation signal, and acquiring a threshold voltage of the driving sub-circuit;

in a data writing stage, inputting a scan signal into a scan signal line, superimposing and writing a data signal inputted into a data signal line and the threshold voltage to the driving sub-circuit;

in a light emission for display stage, inputting a light emission control signal into a second control signal line, and driving the light-emitting sub-circuit by the driving sub-circuit; and in a voltage stabilization stage, inputting a voltage stabilization control signal into the first control signal line, and stabilizing a potential at the first node by the voltage stabilizing sub-circuit, the first node being a connection node between the data writing sub-circuit and the driving sub-circuit, wherein in the reset stage, the threshold acquisition stage, the data writing stage and the light emission for display stage, the first transistor is turned off by a signal inputted through the first control signal line, such that the second terminal of the first storage capacitor is floated.

15. The driving method of claim 14, wherein the data writing sub-circuit comprises a second transistor; the threshold compensation sub-circuit comprises a third transistor and a second storage capacitor; the light-emitting sub-circuit is an organic light-emitting diode; and the driving sub-circuit comprises a driving transistor, the driving method specifically comprising:

in the reset stage, inputting the scan signal into the scan signal line, inputting the reset signal into the second control signal line, and applying a reference voltage to the data signal line to turn on the second transistor, the third transistor and the driving transistor, and applying a low level to a first voltage terminal, so that an anode of the organic light-emitting diode is reset;

in the threshold acquisition stage, inputting a threshold voltage acquisition signal into the second control signal line, and inputting the scan signal into the scan signal line to turn on the second transistor and the third transistor, and storing, in the second storage capacitor, the threshold voltage of the driving transistor, which is equal to a difference between the potential at the first node and a potential at a second node, so as to acquire the threshold voltage of the driving transistor, the second node being a connection node between the driving sub-circuit and the light-emitting sub-circuit;

in the data writing stage, inputting the scan signal into the scan signal line to turn on the second transistor, and turning off the third transistor, so that the data signal inputted into the data signal line and the threshold voltage stored in the second storage capacitor are written to a control electrode of the driving transistor;

in the light emission for display stage, inputting the light emission control signal into the second control signal line, turning on the third transistor and the driving transistor, and applying a high level to the first voltage terminal, so that the organic light-emitting diode is driven to emit light; and in the voltage stabilization stage, inputting the voltage stabilization control signal into the first control signal line, to turn on the first transistor, and applying a high level to the first voltage terminal, so that the potential at the first node is stabilized through the first storage capacitor.

16. The driving method of claim 14, wherein the data writing sub-circuit comprises a second transistor; the threshold compensation sub-circuit comprises a third transistor, a fourth transistor, a second storage capacitor and a third storage capacitor; the light-emitting sub-circuit is an organic light-emitting diode; and the driving sub-circuit comprises a driving transistor, the driving method comprising:

in the reset stage, inputting the scan signal into the scan signal line, inputting the reset signal into a third control signal line, and applying a reference voltage to the data signal line to turn on the second transistor, the fourth transistor and the driving transistor, and inputting a direct current (DC) low level signal into a second voltage terminal, so that an anode of the organic light-emitting diode is reset;

in the threshold acquisition stage, inputting a threshold voltage acquisition signal into the second control signal line, and inputting the scan signal into the scan signal line to turn on the second transistor and the third transistor, and storing, in the second storage capacitor, the threshold voltage of the driving transistor, which is equal to a difference between the potential at the first node and a potential at a second node, so as to acquire the threshold voltage of the driving transistor, the second node being a connection node between the driving sub-circuit and the light-emitting sub-circuit;

in the data writing stage, inputting the scan signal into the scan signal line to turn on the second transistor, and turning off the third transistor, so that the data signal inputted into the data signal line and the threshold voltage stored in the second storage capacitor are written to a control electrode of the driving transistor;

in the light emission for display stage, inputting the light emission control signal into the second control signal line, turning on the third transistor and the driving transistor, and applying a high level to the first voltage terminal, so that the organic light-emitting diode is driven to emit light; and in the voltage stabilization stage, inputting the voltage stabilization control signal into the first control signal line to turn on the first transistor, and applying a high level to the first voltage terminal, so that the potential at the first node is stabilized through the first storage capacitor.

17. The driving method of claim 14, wherein in the voltage stabilization stage, the first transistor is turned on by the voltage stabilizing sub-circuit, such that the potential at the first node is maintained at a potential at the first node in the light emission for display stage.

* * * * *